US008297722B2

(12) United States Patent
Chambers et al.

(10) Patent No.: US 8,297,722 B2
(45) Date of Patent: Oct. 30, 2012

(54) SOFT CLOSE DRAWER ASSEMBLY AND BRACKET

(75) Inventors: Paul F. Chambers, Louisville, KY (US); Kevin M. Ward, Louisville, KY (US); David P. Noe, Jeffersontown, KY (US)

(73) Assignee: Rev-A-Shelf Company, LLC, Jeffersontown, KY (US)

( * ) Notice: Subject to any disclaimer, the term of this patent is extended or adjusted under 35 U.S.C. 154(b) by 337 days.

(21) Appl. No.: 12/629,568

(22) Filed: Dec. 2, 2009

(65) Prior Publication Data

US 2010/0141106 A1 Jun. 10, 2010

Related U.S. Application Data

(63) Continuation-in-part of application No. 12/132,402, filed on Jun. 3, 2008, now Pat. No. 8,091,971.

(51) Int. Cl.
*A47B 95/00* (2006.01)
*A47B 88/00* (2006.01)

(52) U.S. Cl. ..... 312/333; 312/334.6; 312/334.5; 312/330.1

(58) Field of Classification Search ..... 312/334.44–334.47, 333, 330.1, 312/319.1, 325, 334.24–334.43, 334.14, 312/334.15, 334.6, 334.7, 334.4, 334.5
See application file for complete search history.

(56) References Cited

U.S. PATENT DOCUMENTS

| | | | | |
|---|---|---|---|---|
| 2,494,221 | A * | 1/1950 | Wojakowski | 312/334.5 |
| 2,775,501 | A * | 12/1956 | Kyllo | 312/348.4 |
| 2,923,584 | A * | 2/1960 | Broderick, Jr. | 312/317.1 |
| 2,934,390 | A | 4/1960 | Wright | 312/270 |
| 4,575,879 | A | 3/1986 | Cabral et al. | 4/253 |
| 4,720,154 | A | 1/1988 | Seiter | 312/319 |
| 5,201,512 | A | 4/1993 | Rabin | 271/164 |
| 5,251,974 | A * | 10/1993 | Beals | 312/330.1 |
| 5,409,308 | A | 4/1995 | Reuter et al. | 312/319.4 |
| 5,421,647 | A * | 6/1995 | Simons | 312/265.1 |
| 5,524,979 | A | 6/1996 | Carson et al. | 312/319.2 |
| 5,634,702 | A | 6/1997 | Fistonich | 312/270.3 |
| 6,142,596 | A * | 11/2000 | Carson | 312/334.39 |
| 6,336,692 | B1 | 1/2002 | Snyder | 312/312 |
| 6,390,576 | B1 * | 5/2002 | Walburn | 312/348.4 |

(Continued)

FOREIGN PATENT DOCUMENTS

EP 1635025 A1 3/2006

(Continued)

*Primary Examiner* — Darnell Jayne
*Assistant Examiner* — Timothy M Ayres
(74) *Attorney, Agent, or Firm* — Brinks Hofer Gilson & Lione

(57) ABSTRACT

A cabinet slide assembly permits the soft-close action and/or a soft-open action of a drawer. The cabinet slide assembly includes a cabinet, a drawer, and at least one slide mechanism coupling the drawer to the cabinet to permit movement of the drawer between a fully open position and a fully closed position. A gas spring is also included in the assembly having a first end coupled to a portion of the cabinet assembly and a second end coupled to a portion of the drawer assembly. The gas spring is permitted to swing through an arc along a vertical plane as the drawer moves between the fully open position and the fully closed position. An adjustable bracket can also be included in the assembly and is configured for a top mount drawer assembly having a concealed drawer slide mechanism. The bracket is also configured for face frame or frameless cabinet construction.

19 Claims, 15 Drawing Sheets

U.S. PATENT DOCUMENTS

| | | | | |
|---|---|---|---|---|
| 6,553,617 | B1 | 4/2003 | Salice | 16/85 |
| 6,615,450 | B2 | 9/2003 | Salice | 16/85 |
| 6,702,411 | B2 | 3/2004 | Helver | 312/333 |
| 6,752,478 | B1 | 6/2004 | Francz | 312/334.1 |
| 6,799,663 | B2 | 10/2004 | Dubach | 188/322.22 |
| 6,932,200 | B2 | 8/2005 | Booker et al. | 188/300 |
| 6,986,558 | B2 * | 1/2006 | Egger | 312/334.5 |
| 2003/0089565 | A1 | 5/2003 | Salice | 188/283 |
| 2005/0264144 | A1 | 12/2005 | Verbeek et al. | 312/323 |
| 2007/0024166 | A1 | 2/2007 | Sung | 312/319.9 |
| 2009/0295262 | A1 * | 12/2009 | Ward et al. | 312/334.44 |
| 2010/0264794 | A1 | 10/2010 | Hu et al. | 312/319.1 |

FOREIGN PATENT DOCUMENTS

| | | | |
|---|---|---|---|
| EP | 1790251 | A1 | 5/2007 |
| WO | WO 2009/109536 | A1 | 9/2009 |

* cited by examiner

SOFT CLOSE DRAWER ASSEMBLY AND BRACKET

CROSS-REFERENCE TO RELATED APPLICATIONS

This application is a continuation-in-part of U.S. application Ser. No. 12/132,402, entitled "SOFT CLOSE DRAWER ASSEMBLY," filed Jun. 3, 2008 now U.S. Pat. No. 8,091,971, which is incorporated herein by reference in its entirety.

BACKGROUND

The embodiments of the present invention generally relate to drawers that slide in and out of a cabinet. In particular, they relate to mechanisms that control the rate at which a drawer slides in and out of a cabinet such that an abrupt stop of the motion of the drawer is avoided when arriving at a fully closed or open position.

There are presently available a number of rate controlling mechanisms, such as damping and springing mechanisms, that are provided with a drawer or lid of cabinets. Some of the simpler mechanisms include rubber or foam bumpers between the face of the cabinet and the drawer or slide mechanism. Though the bumpers soften the impact of the drawer as the drawer closes, the bumpers are not optimal for heavy or fast moving drawers, and the bumpers are not effective for abrupt stops.

Other rate controlling mechanisms include a springing mechanism located proximate the drawer or lid. For example, in U.S. Pat. No. 5,409,308 to Reuter et al., a cabinet is provided with a curved, upward-swinging door with an opening mechanism that includes a pair of opposed pivot arms. Each of the arms is connected to a gas spring that is connected to the end walls of the cabinet. Each pivot arm includes a circular disk portion integrally formed with a tangential arm and a mounting bracket for mounting each pivot arm to the door. The rod of the gas spring faces downwardly, while the cylinder end faces upwardly so that oil is kept contained within the cylinder. When opening the door, each arm rotates around a central boss of the circular disk in order to cause the gas spring to generate a force tangential to the rotatably mounted circular disk. The force of the gas spring causes the door to continue to open. However, the primary motion of the door is swinging, rather than sliding, and the use of a complexly designed arm is necessary to bear the load of the door and the force of the gas spring while swinging.

Other springing mechanisms are available for drawers that slide. Generally, these mechanisms are integrated with the rails in a complicated manner that often do not allow for easy modifications to conventional drawer-slide rail systems. Furthermore, many of the slide mechanisms only provide for a soft-close action but do not address both the soft-close action and the soft-open action. One example is U.S. Pat. No. 6,752,478 to Francz, which shows a damping mechanism borne on the pull-out rail toward the front of the drawer and parallel to the sides of a drawer. The damping mechanism travels with the movement of the pull-out rail, and remains inoperative until the drawer begins to fully close and an abutment presses against the plunger of the damping mechanism. When the abutment presses against the plunger, the cylinder causes dampening of the drawer and prevents the front panel from striking against the body side walls with a great force. A pull-in device arranged at the rear of a support rail is included to couple a central rail, which runs between the pull-out rail and the support rail. The pull-in device pulls the central rail, together with the pull-out rail, into the furniture carcass, with this movement being dampened by the damping mechanism.

Moreover, many combinations of rate controlling mechanisms and drawer-slide rail systems remain visible when in operation primarily because of space constraints. Opportunities for food and/or fluid to interlace or buildup within the drawer slides are greatly enhanced with visible drawer slides. This can adversely affect the operability of the drawer slides by gumming the oil, increasing the friction between the slides, and increasing the risk of corrosion.

Thus, there remains a need for a drawer and slide mechanism system that allows the drawer to fully close or open gradually without an abrupt stop in order to provide a soft-close action and/or open action. There also remains a need to integrate such system with a concealed drawer-slide rail system.

SUMMARY

In a first embodiment, a cabinet slide assembly is provided to permit a soft-close action and/or a soft-open action of a drawer with respect to a cabinet. The cabinet slide assembly includes the cabinet and drawer and a slide mechanism coupling the drawer to the cabinet to permit movement of the drawer between a fully open position and a fully closed position. The cabinet generally includes a floor, a pair of side walls, and a rear panel attached to the floor, while the drawer generally includes a rear panel and a pair of side panels attached to rear panel. The drawer slide mechanism preferably includes a left and a right drawer slide rail. Preferably, the drawer slide rails are coupled along the interior surface of the drawer side panels in order to conceal the drawer slide rails. This can protect the drawer slide rails from the adverse effects of exposure of solid particles or fluids, such as food and drink. A post can be mounted between the drawer slide mechanism and the cabinet such that the drawer slide mechanism is elevated above the cabinet floor, preferably for a top mount drawer assembly. The post can be mounted to one of the drawer slide rails and positioned a lateral distance away from the cabinet side wall.

The assembly also includes a gas spring that is preferably situated to facilitate a reduction of speed of the drawer as the drawer approaches the fully closed position, the fully open position, or both for permitting the soft-close action and/or the soft-open action. The gas spring can have a first end coupled to the post and a second end coupled to the drawer. The gas spring is capable of swinging through an arc about the first end along a vertical plane, while the second end is movable with the movement of the drawer. The gas spring can include a compressed position upon movement of the drawer through an intermediate position located between the fully open position and the fully closed position, and an extended position when the drawer is at the fully open position, the fully closed position, or both. The gas spring can also be self-extendable from the compressed position to the extended position such that the drawer is movable from the intermediate position without application of a force external to the assembly. The gas spring may also be oriented substantially perpendicular to the slide mechanism when the drawer is at the intermediate position.

In a second embodiment, an adjustable bracket is provided preferably for a top mount drawer assembly that has a concealed drawer slide mechanism. The adjustable bracket can also be adapted for face frame or frameless cabinet construction. Additionally, the adjustable bracket may be combined with the cabinet slide assembly of the first embodiment. The adjustable bracket includes a first bracket and a second bracket. The first bracket has a vertical portion and a lower, horizontal portion extending laterally toward the center of the cabinet. The vertical portion of the first bracket can have one or more holes for receiving a fastener for attachment to a portion of the cabinet. The cabinet portion may include the face frame or the interior surface of cabinet side wall depending on the type of cabinet construction. The second bracket also has a vertical portion and a lower, horizontal portion extending laterally toward the cabinet side wall. The vertical portion of the second bracket can have one or more holes for receiving a fastener for attachment to a portion of each of the drawer slide mechanism. The horizontal portion of each bracket includes one or more holes, where the horizontal portion of the first bracket interfaces the horizontal portion of the second bracket. The holes of the horizontal portion of each bracket are then aligned for receiving a fastener for attachment of the first bracket to the second bracket. The holes of the horizontal portion of each bracket may be arranged in various predetermined patterns for enhancing the ease of installation. The vertical portion of the first bracket can be laterally spaced a distance from the vertical portion of the second bracket such that a portion of the drawer side panel and the respective drawer slide rail fits within the spaced distance.

The adjustable bracket may also include a mending plate that can provide additional structural support along the overlapping portions of the coupled first and second brackets. The mending plate is particularly useful when the laterally spaced distance between vertical portions of the first and second bracket is at its greatest, such as for frameless cabinet construction. The mending plate is configured to interface with the lower surface of the horizontal portion of each bracket. With such interface, one or more first holes of the mending plate is aligned with one or more of the holes of the horizontal portion of the first bracket for receiving a fastener for attachment therebetween, and one or more second holes of the mending plate is aligned with one or more of the holes of the horizontal portion of the second bracket for receiving a fastener for attachment therebetween.

Other features and advantages of the present invention will become apparent to those skilled in the art from the following disclosure of preferred embodiments of the present invention exemplifying the best mode of practicing the invention. The following disclosure references the accompanying drawings illustrating the preferred embodiments.

DESCRIPTION OF PREFERRED EMBODIMENTS

Figure 1:
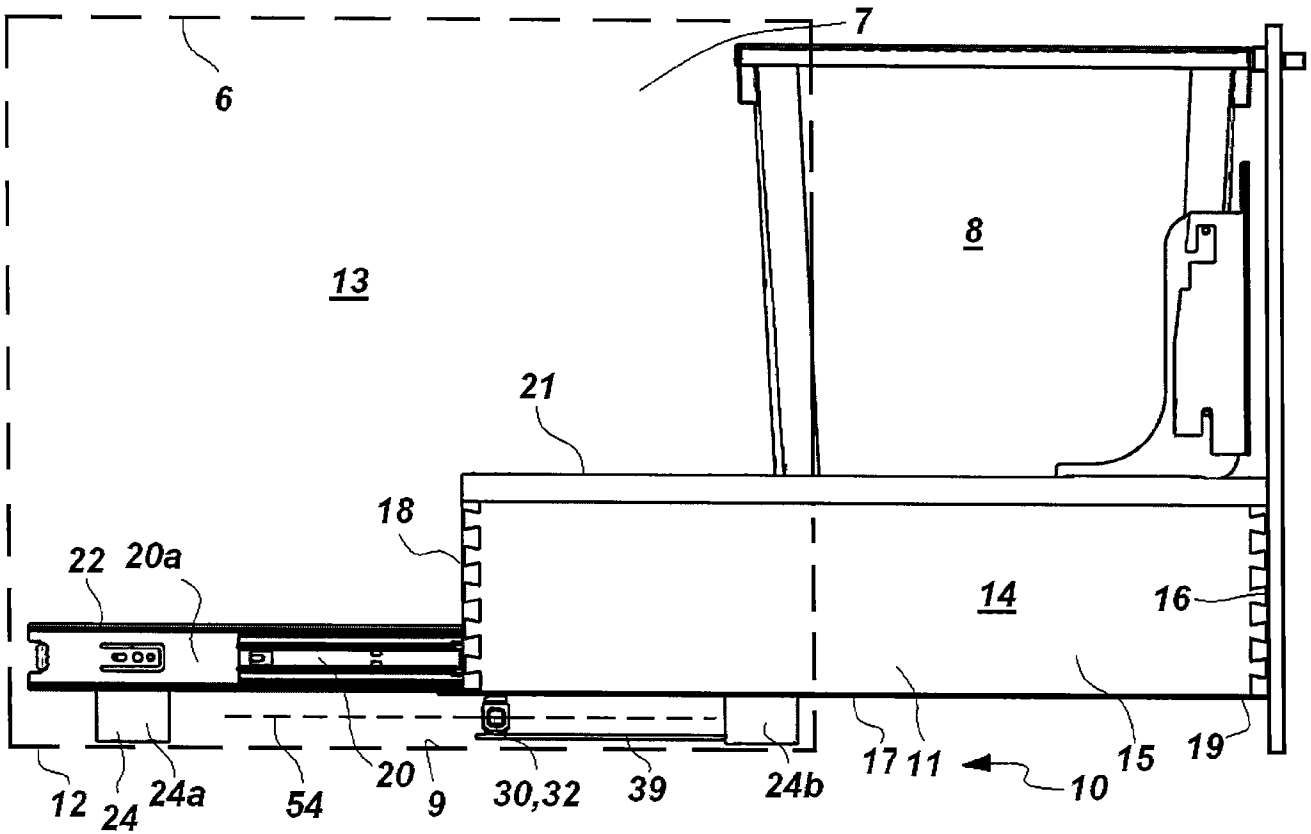
FIG. 1 is a side view depicting one embodiment of a cabinet slide assembly having a gas spring in a horizontal configuration.

Referring to the drawings, where like reference numerals are used throughout the various views to designate like components, and more particularly to FIG. 1 thereof, an soft-close cabinet slide assembly 10 is depicted for allowing a drawer 14 to close or open softly relative to a cabinet 12 (represented by the dashed box). It is to be understood that the cabinet 12 can be any enclosure, such as a kitchen or bathroom cabinet, a paper file cabinet, a tool chest, an industrial or consumer storage cabinet, or any of a variety of enclosures used for housing any object. The cabinet 12 generally includes a floor 9, a roof 6, and a pair of side walls 7. The drawer 14 generally includes a cubical body 15 with a front end panel 16, a rear end panel 18, opposite the front end panel, and a pair of sides panels 11 that when coupled form a middle cavity region 17 positioned therebetween. The drawer 14 also generally includes a bottom panel 19 that is coupled to the front and rear end panels 16, 18 and the side panels 11, and has an underneath surface that faces the cabinet floor 9. Each of the side panels 11 has a top end 21 that faces the roof 6 of the cabinet 12.

The drawer 14 may be a solid piece of wood, a composite structure comprising a variety of materials, or may be of frame and panel construction. The drawer 14 is configured for receiving a load 8 of contents, for example, in FIG. 1 the load 8 is a wastebasket, or any other desired utility device. Examples of such utility devices may include a cutlery station, a lazy susan, a pot or pan holder, a wine rack, a paper file organizer, a tool or appliance holder or storage compartment, or any other such item that a typical homeowner or business operator may wish to have slide out access to in a cabinet or another similar such enclosure. It is to be understood by persons of ordinary skill in the art that the drawer can be just any type of frame configured to slide in and out of a cabinet.

Figure 2:
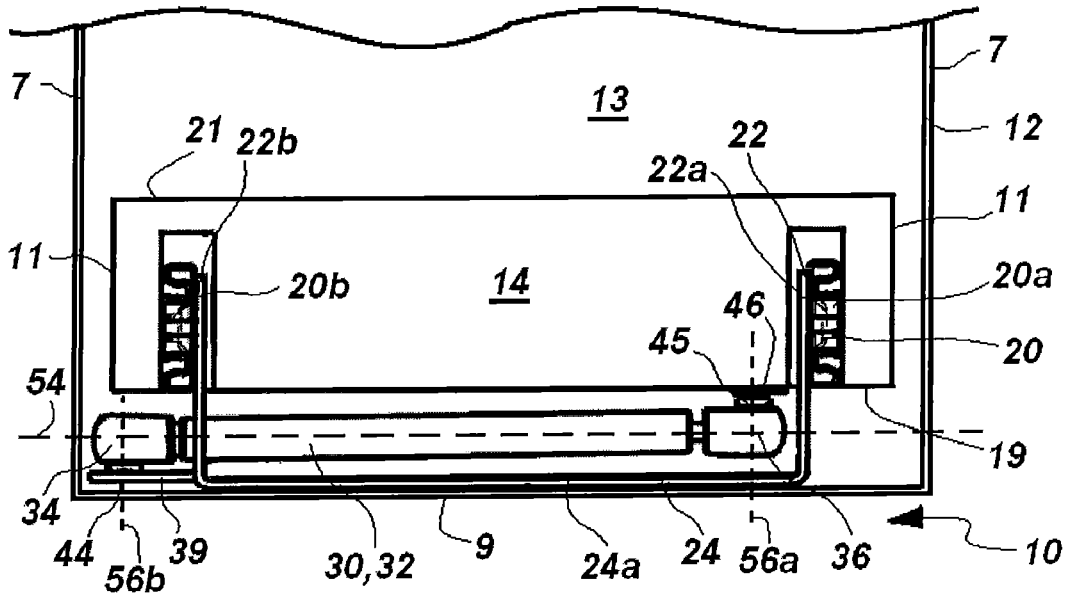
FIG. 2 is an end view of the cabinet slide assembly of FIG. 1.

According to FIG. 2, the drawer 14 slides in and out of the interior 13 of the cabinet 12 by at least one slide mechanism 20, which attaches to a portion of the drawer 14. Another portion of the slide mechanism 20 can attach to an adjacent supporting member 22 that is attached to the cabinet 12 by an attachment mount 24. The drawer slide mechanism 20 generally includes a left drawer slide rail 20*a* and a right drawer slide rail 20*b* that are installed into the cabinet 12. Here, a portion of the left and right drawer slide rails 20*a*, 20*b* can attach to the side panels 11 of the drawer 14, while another portion of the left and right drawer slide rails 20*a*, 20*b* can attach to the adjacent supporting members 22*a*, 22*b*. The adjacent supporting member 22*a*, 22*b* can be attached to the cabinet 12 by a rear attachment mount 24*a* and a forward attachment mount 24*b*. The slide mechanism 20 preferably is parallel with the side walls 7 of the cabinet 12, while the attachment mount 24 preferably is perpendicular to the sides 7 of the cabinet 12.

Figure 3:
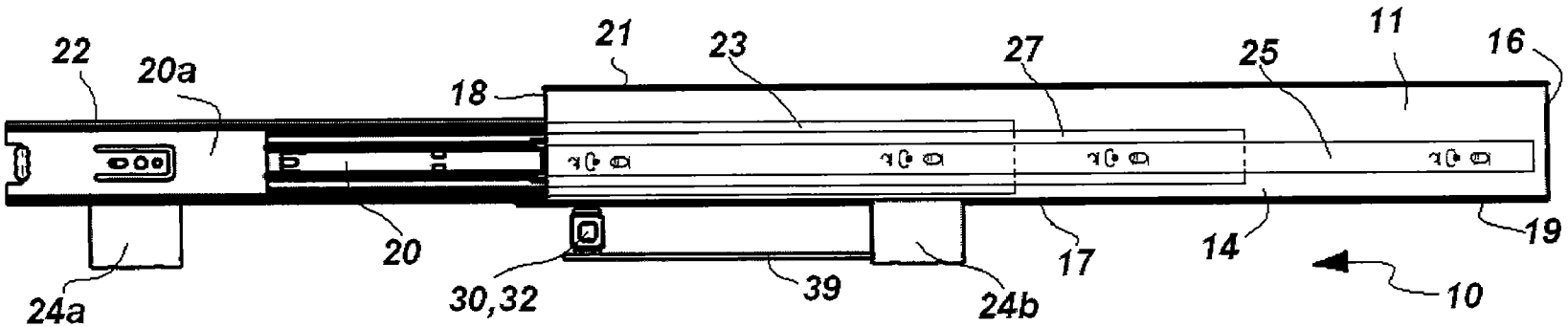
FIG. 3 is a side view depicting a slide mechanism for use with a cabinet slide assembly.

Referring to FIG. 3, each slide mechanism 20 can include a fixed cabinet support rail 23 and a fixed drawer support rail 25. The fixed cabinet support rail 23 can be attached to the adjacent supporting member 22 adjacent to the side panel 11 of the drawer 14. The fixed drawer support rail 25 can be attached to the side panel 11 of the drawer 14 adjacent to the side wall 7 of the cabinet 12. As shown in the figure, the slide mechanism 20*a* can also include a sliding intermediate rail 27 slidably affixed to both the fixed cabinet support rail 23 and the fixed drawer support rail 25 and securably engaged to permit only sliding movement. While the cabinet 12 is intended to remain stationary, the drawer 14 is permitted to move between a fully open position 26 with the drawer 14 substantially outside of the cabinet 12 (see FIG. 4*b*) and a fully closed position 28 with the drawer 14 substantially inside of the cabinet interior 13 (see FIG. 4*c*). As the drawer 14 is moving to the fully open position 26, the sliding intermediate rail 27 is sliding upon the fixed cabinet support rail 23, thereby causing the drawer support rail 25 to slide upon the sliding intermediate rail 27. The load 8 of the drawer 14, and between the rails 23, 25, 27, is transmitted by way of ball bearing slides. Optionally, rollers, preferably rollers in a running carriage, and/or gliding or sliding means can be used. It is to be appreciated that the slide mechanism 20 can include any configuration of railing or drawer sliding mechanism known in the art.

Figure 4A:
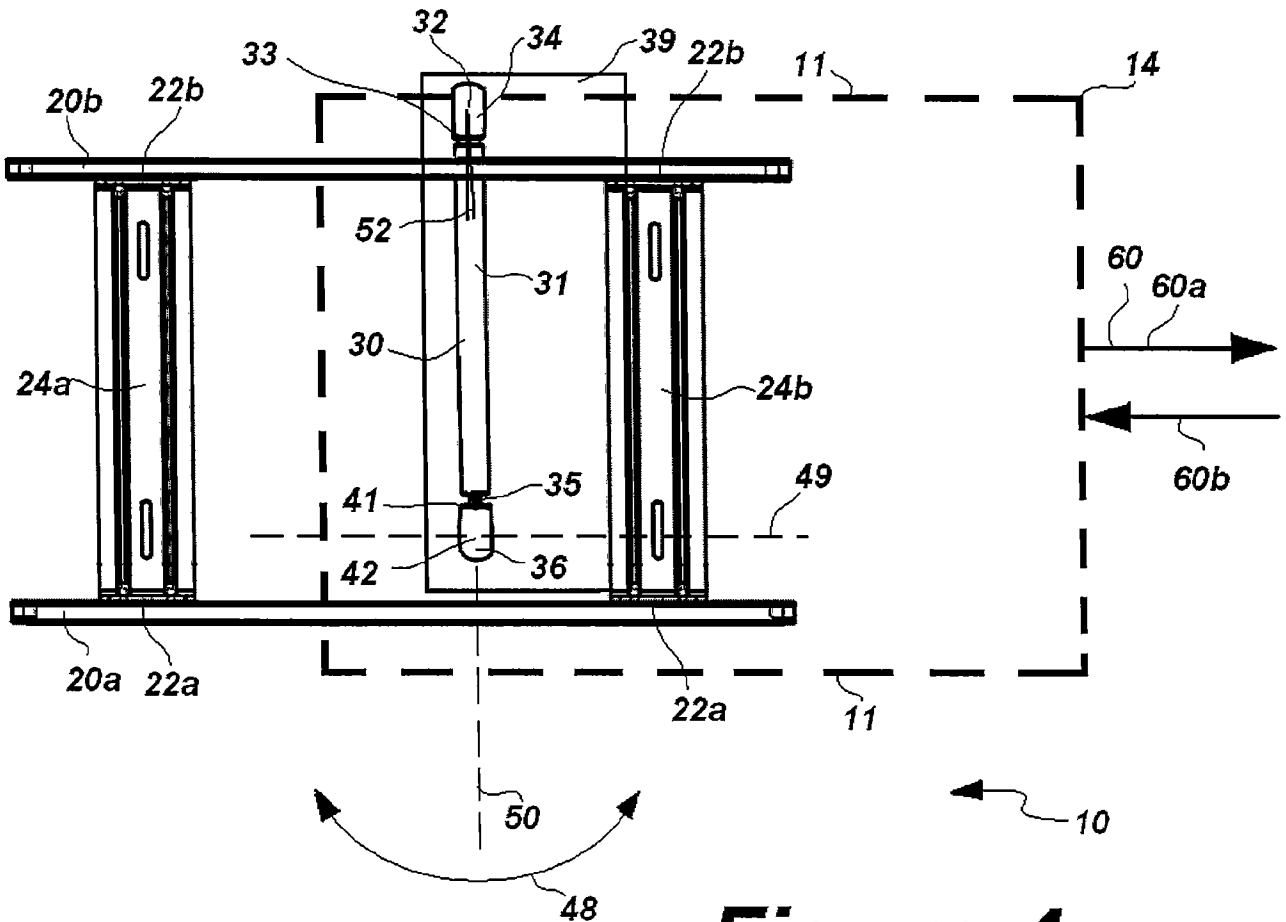
FIGS. 4*a*-4*c* are top views of a cabinet slide assembly shown without the cabinet, depicting a gas spring and a drawer at a middle position, a fully open position, and a fully closed position, respectively.
Figure 4B:
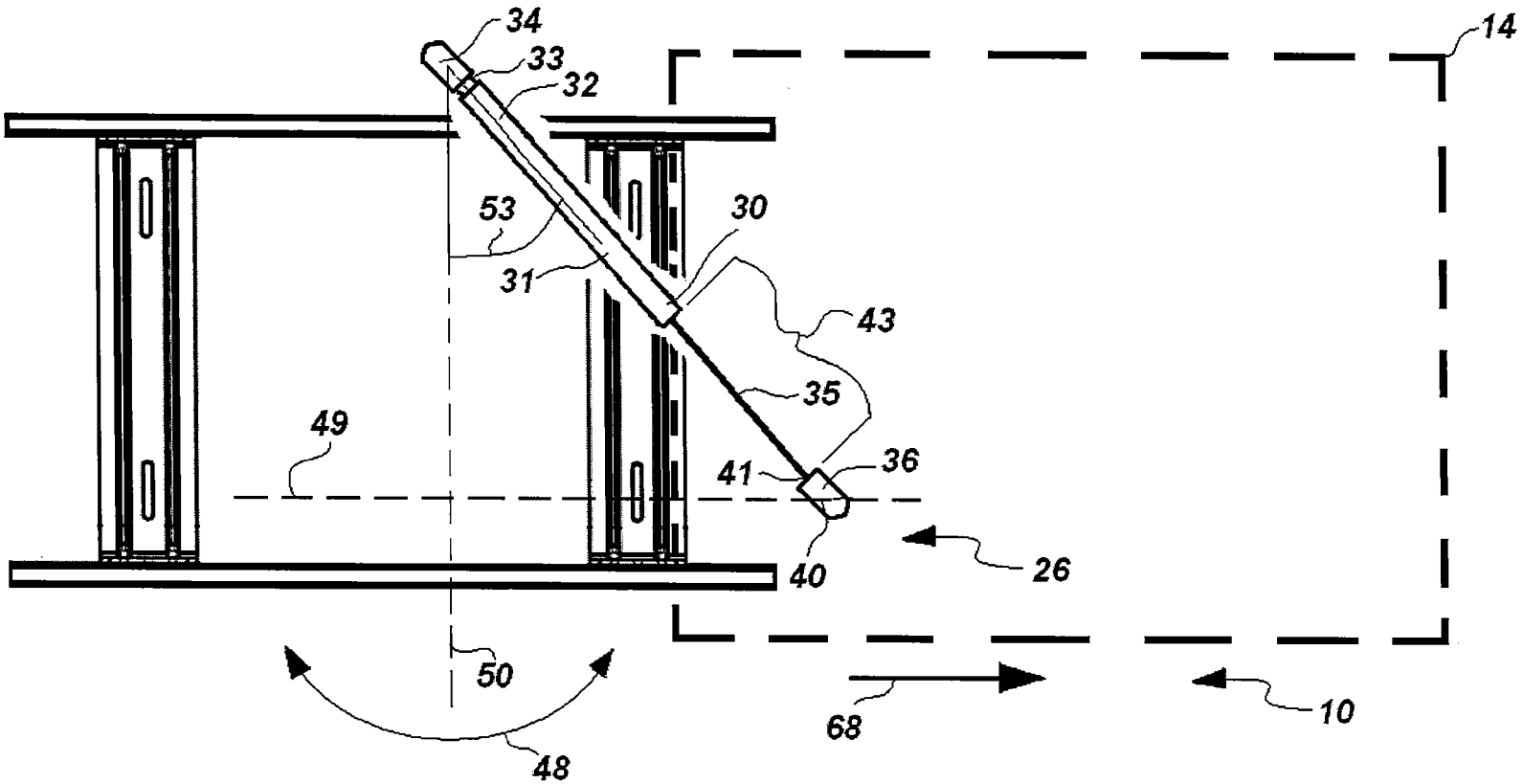
Figure 4C:
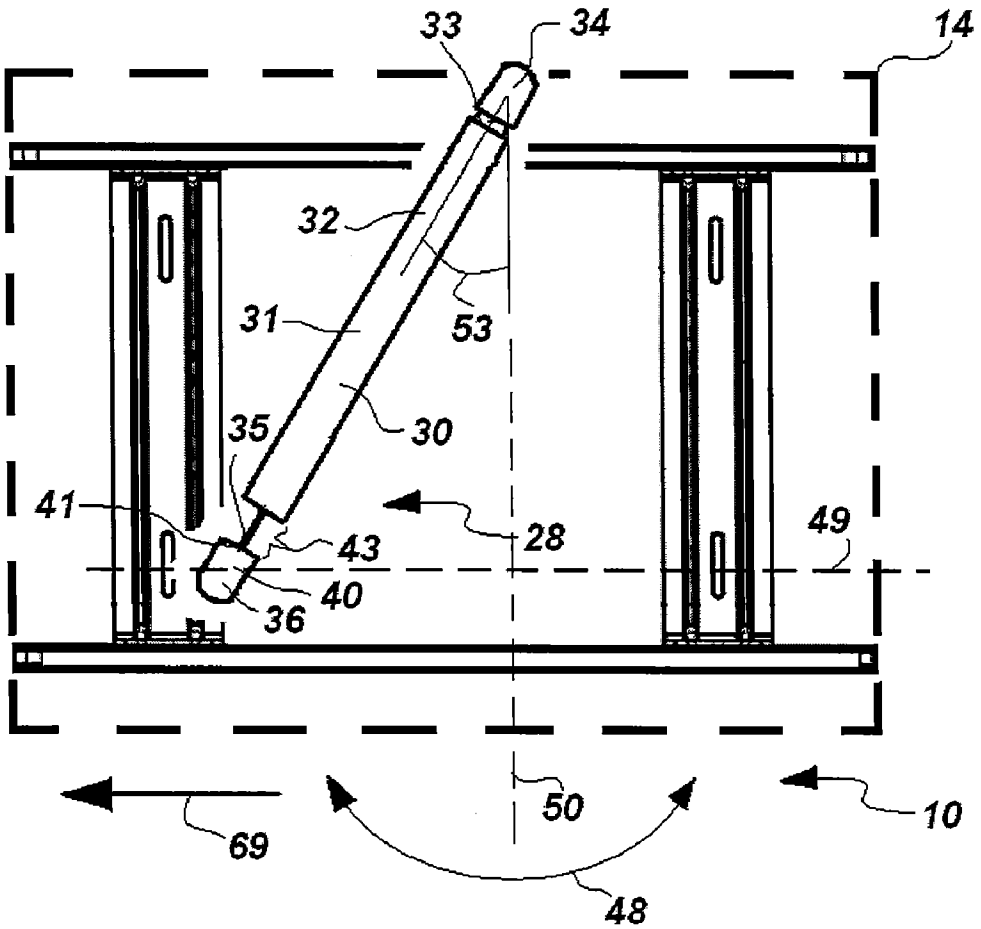

The soft-close cabinet slide assembly 10 also includes a forcing means 30 for exerting an extension force. The forcing means 30 can include: a mechanical spring, a gas spring that provides a controlled extension force with or without a damper, or other equivalent devices known in the art. A preferred embodiment of the present invention includes a gas spring 32. Referring to FIGS. 4*a*, 4*b* and 4*c*, the gas spring 32 can include a cylindrical tube 31 provided with a reciprocating piston (not shown) and a piston rod 35. The extended length (not shown) of the gas spring 32, which is the distance between a cylindrical tube end 33 and a piston rod end 41 when fully extended, can infinitely vary. A typical extended length can be between about 5.0 inches and about 35.5 inches; preferably, between about 5.0 inches and 10 inches. Also shown in FIG. 4*b*, the stroke length 43, which is measured as the total distance the piston rod end 41 travels between the fully open position 26 to the fully closed position 28, can be in the range of about 0 percent to about 50 percent of the extended length 37; preferably, about 30 percent to about 40 percent. High pressure gas, typically nitrogen, air, fluid or oil, or any combination thereof, can be within the cylindrical tube 31 to provide the proper stroke pressure within the gas spring 32. It can be appreciated that the specifications of the gas spring 32 for any given size and weight of the drawer 14 and the load 8 can be calculated in the manner known in the art. The typical exerting force or stroke pressure of a gas spring 32 can be between about 0 pounds (force) per square-inch (psi) to about 250 psi; preferably, about 2 psi to 10 psi. The gas spring 32 can also include a damping means, such as a dashpot or damper. The damping means can resist the motion of the drawer 14 by absorbing a force that is proportional to the velocity of the sliding drawer 14. The damping means preferably acts in the opposite direction of the sliding drawer 14, slowing the motion and absorbing energy of the drawer 14 and the load 8.

Referring to FIGS. 2 and 4*a*, the gas spring 32 can have a first end 34 coupled to any portion of the cabinet 12 or the slide mechanism 20 and a second end 36 coupled to any portion of the drawer 14 or its frame. FIG. 4*a* illustrates the cylindrical tube end 33 proximate the first end 34 and the rod end 41 proximate the second end 36. Alternatively, the cylindrical tube end 33 can be located proximate the second end 36 and the rod end 41 proximate the first end 34. The soft-close cabinet slide assembly 10 can also include a first pivotal coupling 44 at the first end 34 of the gas spring 32. The first pivotal coupling 44 is coupled to proximate the front end panel 16 of the cabinet 12 at a mounting plate 39. The mounting plate is shown extending from one of the attachment mounts 24*b*, but could also be attached to any portion of the slide mechanism and/or cabinet.

In addition, the soft-close cabinet slide assembly 10 can include a second pivotal coupling 46 at the second end 36 of the gas spring 32 that is coupled to the middle region 17 of the drawer 14 at an attachment plate 45. The mounting plate 39 is preferably positioned parallel and affixed to the floor 9 of the cabinet interior 13 and adapted to receive the fixed mounting bracket of the first pivotal coupling 44, while the attachment plate 45 is preferably positioned parallel and affixed to the bottom panel 19 of the drawer 14 and adapted to receive the fixed mounting bracket of the second pivotal coupling 46.

The pivotal couplings 44, 46 are configured to permit the gas spring 32 to swing through an arc 48 as the drawer 14 moves between the fully open position 26 and the fully closed position 28. Preferably, the first end 34 coupled to the cabinet 12 remains stationary, and the second end 36 attached to the drawer 14 translates with the sliding drawer 14 along a substantially linear path 49. The second end 36 or the second pivotal coupling 46 can translate outside the cabinet 12 when the drawer 14 is at the fully open position 26; preferably, the second end 36 remains inside the cabinet 12. The gas spring 32 can be situated to facilitate a reduction of speed of the drawer 14 when approaching either the fully open or closed positions 26, 28.

The gas spring 32 can move between an extension position 40 and a compressed position 42. The extension position 40 can be when the rod 35 is at 100 percent extension, or fully extended, or less than 100 percent extension. The compressed position 42 can be when the rod 35 is at 100 percent compression, or fully retracted, or less than 100 percent compression. In other words, the rod 35 need not be fully extended to reach the extension position 40 and need not be fully compressed to reach the compressed position 42. When the gas spring 32 is at the compressed position 42, the drawer 14 is generally moving through a middle position 50, as illustrated in FIG. 4*a*, which is at a location between the fully open position 26 and the fully closed position 28 of the drawer 14. The gas spring 32 is preferably substantially perpendicular to the slide mechanism 20 when the drawer 14 is at the middle position 50, that is, when an angle 52 is about 0 degrees. However, the gas spring 32 can be at the angle 52 of plus or minus 20 degrees when the drawer 14 is at the middle position 50.

When the gas spring 32 achieves the extension position 40, or being less compressed than the compressed position 42, the drawer 14 can be positioned at either the fully open position 26 (see FIG. 4*b*) or the fully closed position 28 (see FIG. 4*c*). The gas spring 32 can be at an angle 53 in the range of about 20 degrees to about 60 degrees when the drawer 14 is at the fully open position 26 or the fully closed position 28. The first end 34 and the second end 36 of the gas spring 32 can be positioned such that the change in gas spring compression is maximized as the drawer 14 approaches either the fully open 26 or the fully closed position 28.

Figure 6:
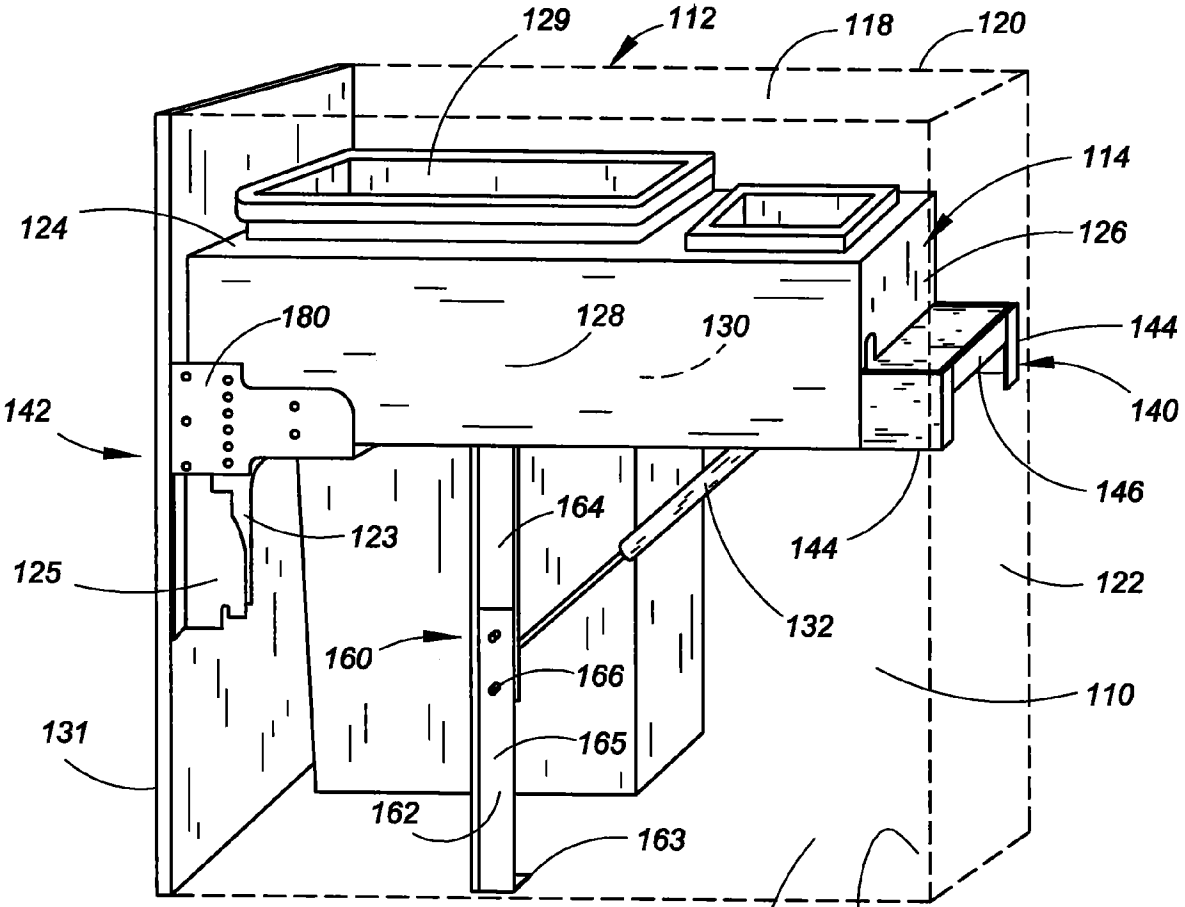
FIG. 6 is a perspective view of a cabinet slide assembly having a gas spring in a vertical configuration.

The gas spring 32 can be located anywhere on the drawer 14 or cabinet 12 as appreciated by those of ordinary skill in the art. According to FIG. 2, the gas spring 32 is preferably located in a space between the drawer bottom panel 19 and the cabinet floor 9 in a horizontal configuration and substantially parallel to the drawer bottom panel 19 and cabinet floor 9. Here, the gas spring 32 can operate in a plane 54 substantially parallel to the drawer bottom panel 19 and cabinet floor 9, transversing the sides 7, 11 of the cabinet 12 and drawer 14 while operating. Thus, each of the first and second ends 34, 36 can pivot about a vertical axis 56*a*, 56*b* that is substantially perpendicular to the operative plane 54 of the gas spring 32. Optionally, the gas spring 32 can be in a vertical configuration, located along the sides of the drawer and the cabinet as shown in FIG. 6, and operate in a similar fashion described herein.

In general, an operator of one of the embodiments of the soft-close cabinet slide assembly 10 can apply an external force 60 on the drawer 14 to place the drawer 14 in either the fully open position 26 or the fully closed position 28. Referring to FIGS. 4*a*-4*c*, to open the drawer 14 to the fully open position 26 from the fully closed position 28, the operator can apply the external force 60*a* for pulling a handle on the front end panel 16 of the drawer 14, or to the drawer 14 directly. The external force 60*a* is sufficient to overcome the extension force of the gas spring 32 in order for the drawer to begin moving toward the outside of the cabinet 12, represented by arrow 68. Preferably, the external force 60*a* is applied until the drawer 14 moves through the middle position 50, after which the external force 60*a* can be removed from the drawer 14. Likewise, to close the drawer 14 to the fully closed position 28 from the fully open position 26, the operator can apply the external force 60*b* for pushing the handle on the front end panel 16 of the drawer 14, or to the drawer 14 directly. The external force 60*b* is sufficient to overcome the extension force of the gas spring 32 for moving the drawer 14 toward the interior 13 of the cabinet 12, represented by arrow 69. Preferably, the external force 60*b* is applied until the drawer 14 moves through the middle position 50, after which the external force 60*b* can be removed from the drawer 14.

Figure 5:
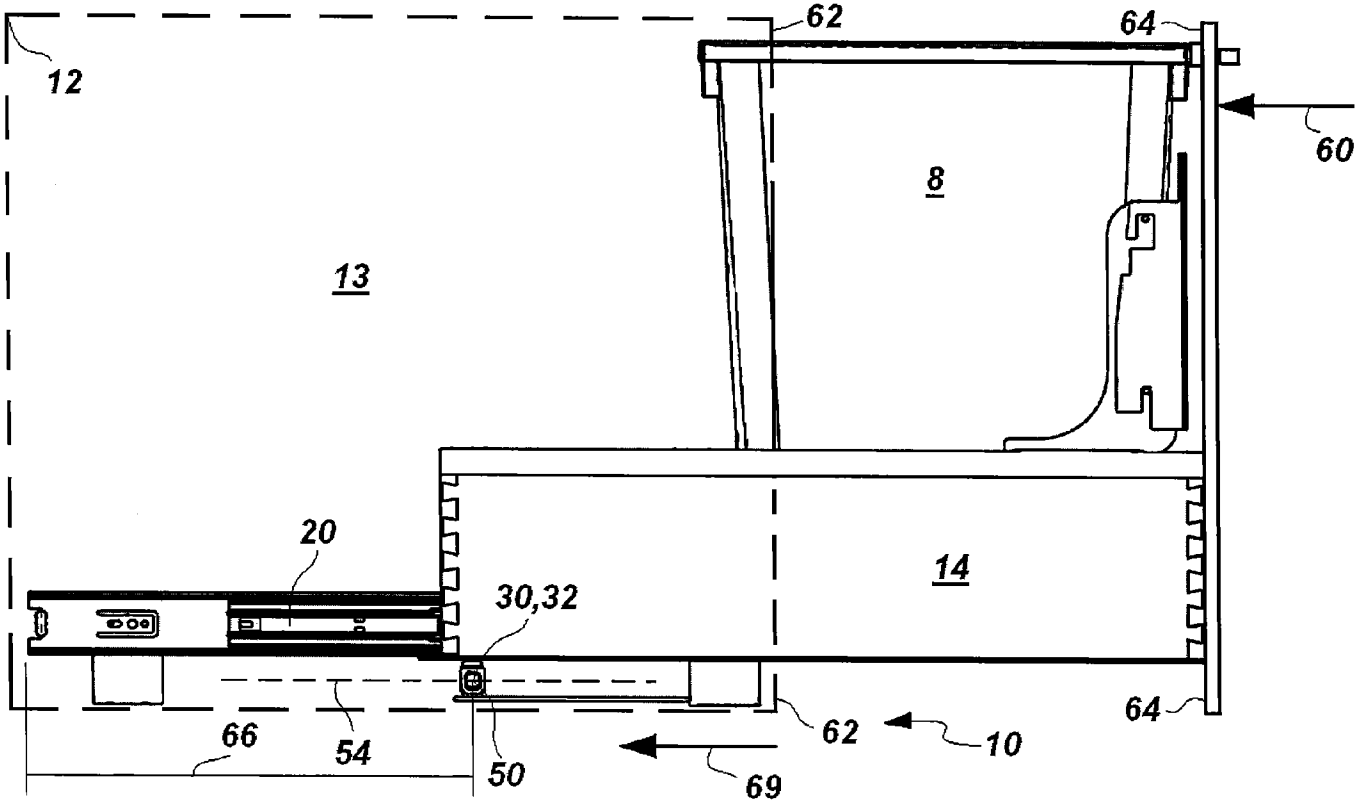
FIG. 5 is a side view of a cabinet slide assembly, depicting a soft-close action.

Referring to FIG. 5, the soft-close action of the drawer 14, and thus the reduction of effort by an operator, is illustrated with the following. As the drawer 14 approaches the middle position 50 from either the fully closed or open positions 28, 26, the drawer 14 and load 8 exert a compressive force on the piston and rod 35, which have a tendency to exert an extension force because of the gas in the gas spring 32. As a result, the piston and rod 35 of the gas spring 32 approaches the compressed position 42, where the piston contacts oil within the cylinder, causing the oil to pass through an orifice in the piston. Thus, the drawer 14 experiences a reduction of speed, or decelerates, until the drawer 14 reaches the middle position 50.

As the drawer 14 leaves the middle position 50 to approach the fully closed or open positions 28, 26, the piston and rod 35 of the gas spring 32, because of the force of the gas, exert an extension force on the drawer 14 and load 8, which causes the drawer 14 to accelerate with an increased speed. As a result, the piston and rod 35 of the gas spring 32 approaches the extension position 40 or a fully extended position, where the piston contacts oil within the cylindrical tube 31, causing the oil to pass through the orifice in the piston. Thus, the drawer 14 experiences a reduction of speed, or decelerates, and gives a soft-open action when the drawer 14 is at the fully open position 26 and/or a soft-close action when the drawer 14 is at the fully closed position 28. Alternatively, the gas spring 32 includes other damper means to control the speed during the soft-close open or closed action.

Alternatively, as the drawer 14 is experiencing an increase in acceleration, the drawer 14 can be prevented from moving passed the fully open position 26 and/or the fully closed position 28 by physical stops positioned on the slide mechanism 20 and/or drawer 14. For example, the face 62 of the cabinet 12 can engage the overhang 64 of the face of the drawer 14 to stop the drawer 14. Here, the area 66 of movement of the drawer 14 between the middle position 50 and the fully closed position 28 is small enough, where the soft-close action is executed by the slower acceleration of the drawer 14 moving toward the interior 13 of the cabinet 12, represented by arrow 69. The drawer 14 can also experience a slower acceleration to execute the soft-open action as the drawer 14 moves away from the interior 13 of the cabinet 12. The soft-close cabinet slide assembly 10 can perform only the soft-close action or only the soft-open action, or can perform both the soft-close action and the soft-open action.

Figure 7:
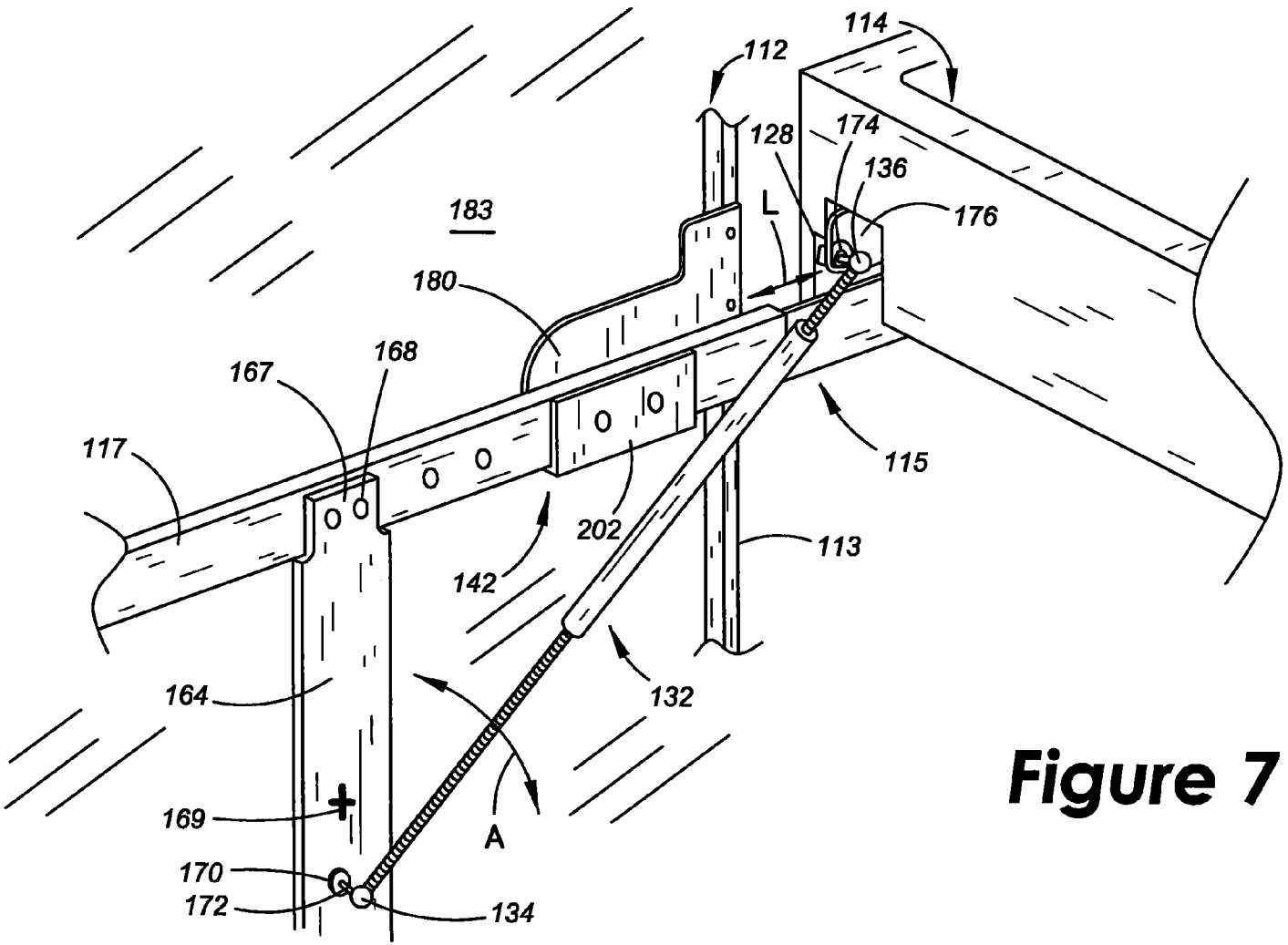
FIG. 7 is a rearward perspective view of a drawer of the cabinet slide assembly of FIG. 6 in the fully open position.
Figure 7A:
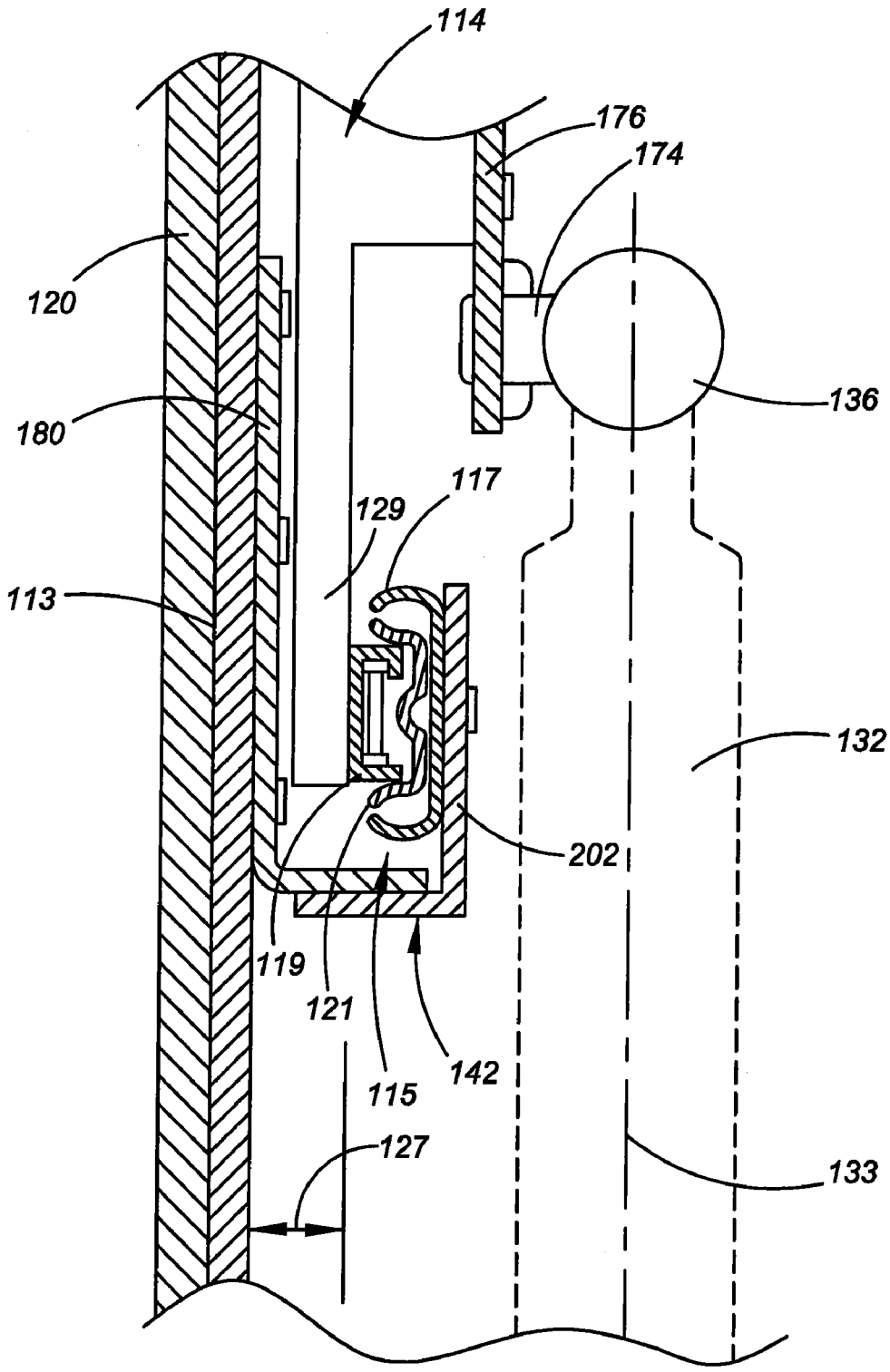
FIG. 7*a* is a cross-sectional view depicting the relative position of an adjustable bracket, a drawer, and a gas spring.

FIGS. 6-7*a* depict the forcing means, such as the gas spring 132, mounted in a vertical configuration, and new reference numerals are used in the figures to designate components substantially identical to the ones in the previous figures. Here, the first end 134 of the gas spring 132 is affixed at a portion of the cabinet 112 or the drawer slide mechanism 115 and the second end 136 is affixed at a portion of the drawer 114 or another portion of the drawer slide mechanism. It is preferable that the gas spring 132 swings through an arc, represented by arrows A, by pivoting about the first end 134; thereby allowing the second end 136 to move along the same, substantially linear path, represented by arrows L, as the movement of the drawer 114, as shown in FIG. 7. The motion of the gas spring 132 is along a plane 133 that is substantially parallel to the cabinet side walls 120. Preferably, the plane 133 is situated near one of the cabinet side walls 120. A spacer (not shown) may be attached to one of the ends of the gas spring in order to lengthen the total extended length of the gas spring.

FIG. 6 illustrates one embodiment of a cabinet and slide assembly 110 incorporating the gas spring 132 mounted in the vertical configuration. The assembly 110 includes a cabinet 112 (shown in dashed lines), a drawer 114, and a drawer slide mechanism 115 that couples the slidable drawer 114 to the stationary cabinet 112. Like cabinet 12, the cabinet 112 generally includes a floor 116, a roof 118, a pair of side walls 120 that couples the roof to the floor, and rear panel 122 attached to each of the floor, roof and side walls.

The cabinet 112 may or may not have a front panel depending on the type of construction: face frame or frameless. A face frame construction, shown in FIG. 7, includes a front frame 113, opposite the rear panel 122, which attaches to the front edges of the cabinet 112 and defines an opening for receiving the drawer 114. Frameless construction would not include the front frame, and the front edges of the floor, roof, and sidewalls of the cabinet would define the front surface. The drawer 114 generally includes a cubical body with a front end panel 124, a rear end panel 126, opposite the front end panel, and a pair of sides panels 128 connecting the front end panel to the rear end panel, that when coupled form a middle cavity region 130 positioned therebetween. The drawer 114 shown in FIG. 6 supports one wastebasket 129, although the drawer may be further adapted for supporting more than one wastebasket. It is to be understood by persons of ordinary skill in the art that the drawer may include a top and/or bottom surface, or optionally, may support items other than wastebaskets. Attached to the front end panel is a cabinet door 131; preferably, an inset door set to be flushed with the front side of adjacent cabinets.

With additional reference to FIGS. 7 and 7*a*, the drawer 114 slides in and out of the interior of the cabinet 112 by at least one drawer slide mechanism 115. The drawer slide mechanism 115 generally includes a left drawer slide rail and a right drawer slide rail. The rear regions of the left and right drawer slide rails can be coupled together by a rear slide mount assembly 140 that is then attached to the interior surface of the cabinet rear panel 122. A portion of the rails can also be coupled to the cabinet 112 toward the front thereof by an adjustable bracket 142. Each of the left and right drawer slide rails is preferably spaced from the cabinet side walls 120 by a distance 127 greater than the width of the drawer side panels 128. This allows sufficient space between the cabinet side walls 120 and drawer slide rails so that the drawer side panels 128 can be located therebetween in order to conceal the drawer slide rails, while permitting the drawer to move in-and-out of the cabinet with relative ease. In the concealed arrangement, the drawer side panels 128 help protect the drawer slide mechanism from exposure of solid particles or fluids, such as food and drink. Food and drink can cause the drawer slide rails to not work properly by entering into the tracks, gumming up the oil, or causing the drawer slides to corrode prematurely.

Each of the drawer slide rails of the drawer slide mechanism 115 can include a fixed cabinet support rail 117 and a fixed drawer support rail 119. The cabinet support rail 117 can be attached to various supporting members adjacent to the cabinet side wall 120. The drawer support rail 119 can be attached along the drawer side panel 128. The drawer support rail 119 may also include a support plate 123 for providing additional support to the door 131. The support plate preferably extends vertically along the interior surface of the door 131 and perpendicular to the horizontally mounted drawer support rail. The support plate 123 may also be coupled to a door mounting plate 125 configured to couple along the interior face of the door 131.

According to FIG. 7*a*, the drawer slide rails can also include one or more sliding intermediate rails 121 that are slidably attached to both the cabinet and drawer support rails 117, 119 and securably engaged to permit sliding movement. While the cabinet 112 is intended to remain stationary, the drawer 114 is permitted to move between a fully open position by moving substantially outside of the cabinet and a fully closed position by moving substantially inside of the cabinet interior. As the drawer 114 is moving between the fully open and closed positions, the sliding intermediate rail 121 is sliding upon the cabinet support rail 117, thereby causing the drawer support rail 119 to slide upon the sliding intermediate rail 121. The load of the drawer, and between the rails, preferably is transmitted by way of ball bearing slides. Optionally, rollers, such as in a running carriage, and/or gliding or sliding means can be used instead of the ball bearing slides.

With reference back to FIG. 6, the rear slide mount assembly 140 attaches to the interior surface of the cabinet rear panel 122 in alignment with the drawer slide rails. The rear slide mount assembly 140 includes a rear slide bracket 144 that can be attached to the rear end of the drawer slide rails and a rear strap 146 that attaches to each of the rear slide brackets 144. The rear slide bracket 144 can include a "L-shaped" body having the long leg member interfacing with the fixed cabinet support rails 117 and the short leg member interfacing with the rear strap 146 and the interior surface of the cabinet rear panel 122. The rear strap 146 can provide suitable and repeatable spacing between the drawer slide rails and alignment in order to avoid binding of the drawer slides and inoperability.

A post 160 mounted between the support rails and the cabinet can be positioned in order to elevate the drawer above the cabinet floor. The post can be mounted to any portion of the cabinet, such as the side walls or the floor, to provide a support for mounting the gas spring as appreciated by one of ordinary skill in the art. With reference to FIGS. 6 and 7, the post in one preferred embodiment is an upright, adjustable foot, referred to now as reference numeral 160, that attaches between an intermediate portion of one of the cabinet support rails 117 and the cabinet floor 116. The adjustable foot 160 can provide support for the drawer slide mechanism 115, which can be elevated from the cabinet floor for top mount assembly, and provide a mounting place for one end of the gas spring 132. The adjustable foot preferably includes foot member 162 and an adjustable member 164 slidably attached to the foot member. The foot member 162 preferably has an "L-shape" where the short leg member 163 extends horizontally toward the cabinet interior and the long leg member 165 extends upright such as vertically and can be formed as a channel facing away from the cabinet interior. The short leg member 163 includes one or more holes for receiving fasteners for attachment to the cabinet floor 116. The long leg member 165 also includes one or more holes 166 for receiving fasteners for attachment to the adjustable member 164.

The adjustable member 164 can also have a channel shape, which is positioned along most of the length of the body. In other words, the adjustable member 164 can include an extended portion 167 that does not have the lateral edges of the channel shape, which is configured to extend past the bottom edge of the cabinet support rail 117 for attachment thereto. The extended portion 167 has one or more holes 168 for receiving fasteners for attachment to the fixed cabinet support rail 117. The channel portion of the adjustable member 164 is sized to slide over the channel of the long leg member 165 of the foot member 162. The channel portion includes one or more openings 169, such as slots, for communicating with the holes 166 of the long leg member 165 of the foot member 162 and for receiving the fasteners for securable attachment therebetween. The slots, as well as the slidability of the adjustable member 164 with respect to the foot member 162, provide greater height adjustability during installation.

The adjustable member 164 also includes an opening 170 for mounting one end 134 of the gas spring 132. In one example, a mounting stud 172, preferably a ball stud for coupling to a ball socket mounting end of the gas spring, is attached through the opening 170. The other end 136 of the gas spring 132 is shown attached to the drawer 114. In one example, the drawer 114 also includes a mounting stud 174 attached to the interior surface of the drawer side panel 128 by a mounting bracket 176, as shown in FIGS. 7-7*a*. The mounting bracket 176 preferably includes a first portion 177 and a second, elevated portion 179. The first portion 177 includes one or more openings 181 for receiving fasteners for attachment to the drawer side panel 128, preferably toward the rear panel 126. The second portion 179 is elevated with respect to the first portion 177 away from the interior surface of the drawer side panel 128 at a specified distance and includes an opening for receiving the mounting stud 174. As shown in FIGS. 7 and 7*a*, the drawer rear panel 126 can have a slot 135 formed in the wall thereof. The slot 135 is dimensioned to receive a portion of the gas spring 132 such that the second end 136 of the gas spring can couple to the mounting stud 136 extending laterally from the drawer side panel 128.

The ends 134, 136 of the gas spring 132 are mounted to their respective portions such that the ends are in alignment in order for the gas spring 132 to swing along a singular plane. The orientation of this plane can provide sufficient clearance to permit the gas spring 132 to swing slightly inside of the drawer slide rail 117, e.g., a swinging clearance of 3/32" from the rail. The mounting stud 172 can then be positioned from the surface of the adjustable member 164 and the mounting stud 174 can then be positioned from the surface of the drawer side panel 128 to permit the gas spring 132 to swing along the singular plane. Accordingly, the mounting studs can be fixedly attached at a predetermined distance, such as by welding to the respective opening, or alternatively may be threadably attached to allow for adjustment during installation to ensure swinging along a singular plane. It is to be understood by persons of ordinary skill in the art that any type of coupling mechanisms can be used to couple the gas spring to the drawer and to the cabinet or drawer slide mechanism so long as the gas spring can swing while maintaining a fixed relationship with the cabinet and drawer.

Now with reference to FIGS. 8*a*-9*d*, the adjustable bracket 142 is provided to couple a portion of the drawer slide mechanism 115, preferably the front end of the fixed cabinet support rail 117, to the front end of the cabinet 112 toward the top thereof. The adjustable bracket 142 is configured to fit any face frame applications, such as 1½", 1⅝", and 1¾" face frames, as well as frameless construction.

Figure 8A:
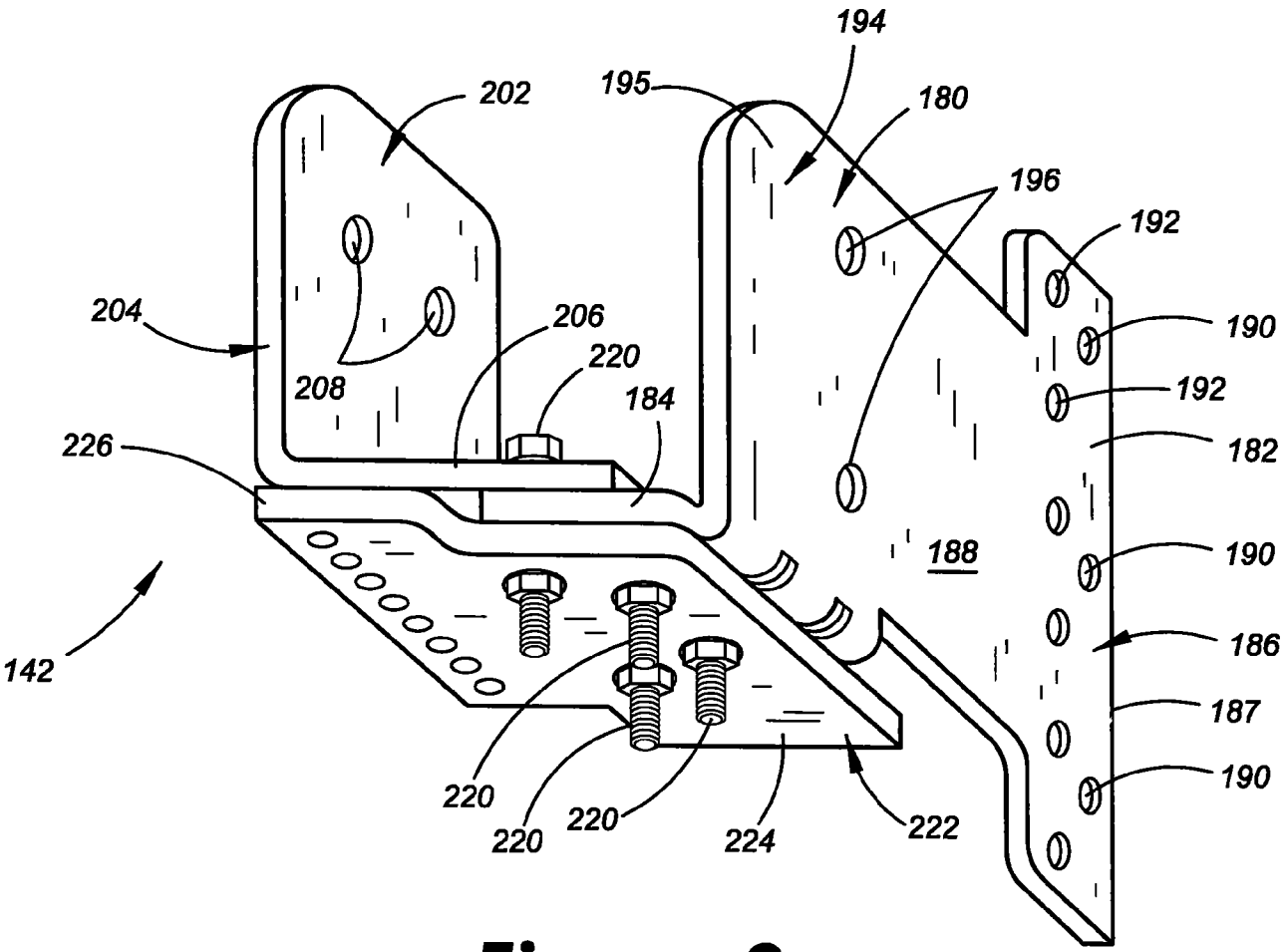
FIG. 8*a* is a perspective view of an adjustable bracket.

According to FIG. 8*a*, the adjustable bracket 142 includes a first bracket 180 that attaches to the face frame 113 for face frame construction, as shown in FIG. 7, or the interior surface 183 of the cabinet side wall for frameless construction. The first bracket 180 has a vertical portion 182 and a lower horizontal portion 184 coupled thereto that extends inward away from the interior surface 183 of the cabinet side wall. The vertical portion can include a front portion 186, preferably having a generally rectangular body, having an edge 187 that is to be flush with the face of the cabinet 112. For face frame construction, the lateral surface 188 of the first bracket vertical portion 182 is located against the lateral surface of the face frame 113. On the other hand, for frameless construction, the lateral surface 188 is located against the interior surface 183 of the cabinet side wall.

Regardless, the front portion 186 can include one or more first holes 190 along the front edge 187, preferably aligned parallel with the front edge 187. The first holes 190 can be sized to receive fasteners for attachment to a portion of the cabinet 112 and can be equally spaced from one another. The first holes 190 can have a countersink, preferably about 75° to 85° countersink relative to the surface, opposite the lateral surface 188. The front portion 186 may also include one or more second holes 192 spaced from the first holes 190 in the rearward direction. The second holes 192 are preferably aligned in a similar fashion as the first holes, i.e., parallel with the front edge 187. The second holes 192 can also be for receiving fasteners for attachment to a portion of the cabinet 112, and are generally located 16 mm center-to-center to accommodate European cabinet construction. Extending from the front portion in the rearward direction is the rear portion 194 of the first bracket 180. The rear portion 194, preferably having a generally rectangular body, can have a smaller height than the front portion 186 such that the front portion 186 extends past the edges of the rear portion 194. One corner 195 of the rear portion 194 may also be arcuate. The rear portion 194 also includes one or more holes 196. In one aspect, the rear portion holes 196 are for fastening to the interior surface of the cabinet side walls for additional support, and may also have a countersink similar to the first holes 190 of the front portion. In another aspect, the holes 196 can be provided and sized to provide access for tools needed to fasten the various components.

Figure 9A:
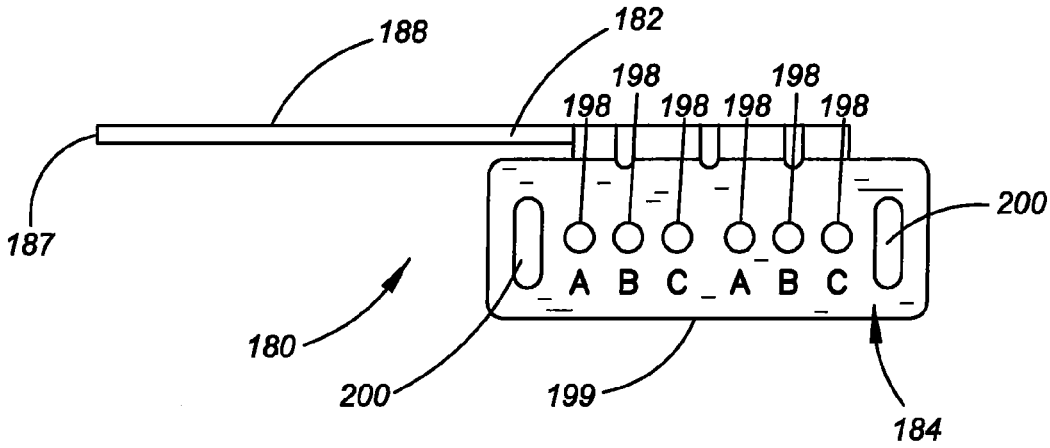
FIG. 9*a* is a top view of a first bracket of an adjustable bracket.

In FIG. 9*a*, the first bracket horizontal portion 184 is shown extending from the rear portion of the first bracket vertical portion 182. The horizontal portion 184 is also generally rectangular and can extend past the rear edge of the vertical portion. Also, the horizontal portion 184 can include one or more openings 198. For example, a series of openings can be positioned at the center of the horizontal portion along the lateral edge 199. Preferably, the series of openings 198 are further divided into pairs; for example, three pairs are labeled A, B, and C. As shown, the openings of a pair are found on the opposite sides of a center line, and the openings themselves can be symmetric about the center. The spacing and orientation of the pairs labeled A, B, and C generally correspond to 1½", 1⅝", and 1¾" face frame construction, although it is to be understood by persons of ordinary skill in the art that spacing and orientation of the openings can vary depending on the desired location of the first bracket. The first bracket horizontal portion 194 may also include a slot 200 along one or more of the rear and front edges thereof. Strengthening ribs may also be included at the transition between the vertical and horizontal portions.

Referring back to FIG. 8*a*, the adjustable bracket also includes a second bracket 202 that attaches to the drawer slide mechanism 115, preferably to the fixed cabinet support rail 117 as shown in FIG. 7. The second bracket 202 has a vertical portion 204 and a lower, horizontal portion 206 coupled thereto that extends outward toward the interior surface 183 of the cabinet side wall. As shown in FIG. 9*c*, the vertical portion 204 preferably has a generally rectangular body, and can have one corner 205 arcuate similar to the corner 195 of the first bracket rear portion 194. The second bracket vertical portion 204 can include one or more first holes 208 along the top edge, preferably aligned parallel with the top edge, which are for receiving fasteners, such as rivets, for attachment to the drawer slide mechanism 115.

Figure 9B:
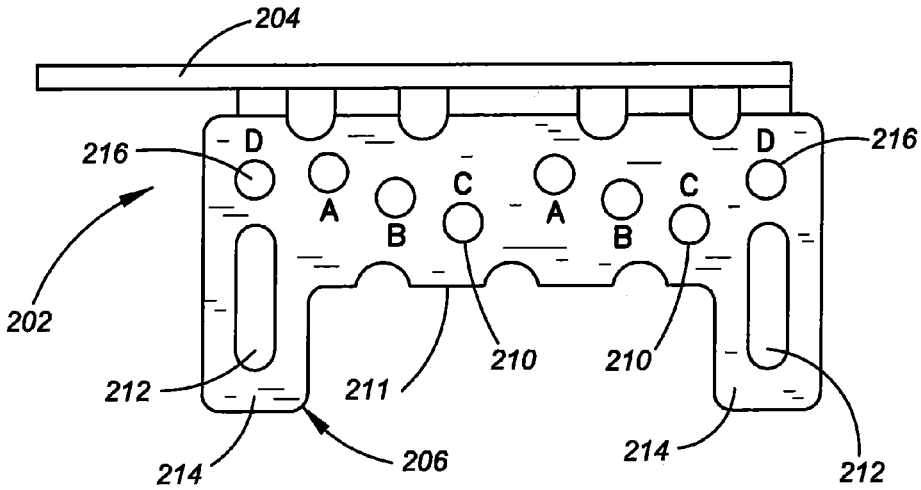
FIG. 9*b* is a top view of a second bracket of an adjustable bracket.
Figure 9C:
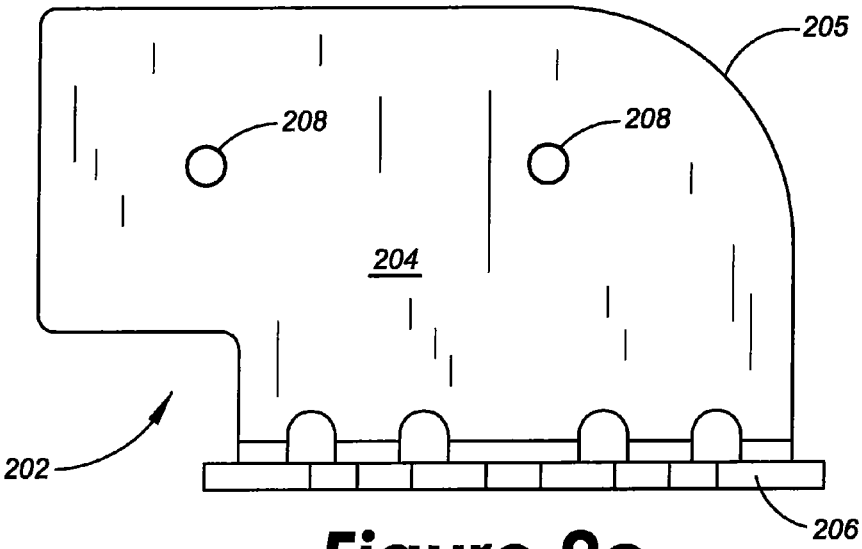
FIG. 9*c* is a side view of the second bracket of FIG. 9*b*.

In FIG. 9*b*, the second bracket horizontal portion 206 is generally a rectangular body and sized and oriented such that a portion of the vertical portion 204 extends past the front edge of the horizontal portion 206, and a portion of the horizontal portion 206 extends past the rear edge of the vertical portion 204, as shown in the figures. Also, the horizontal portion 206 can include one or more openings 210. For example, a series of openings can be positioned along various portions of the body along the lateral edge 211.

Preferably, the series of openings 210 are further divided into pairs; for example, three pairs are labeled A, B, and C. The pairs labeled A, B, and C of the first bracket 180 preferably correspond to the pairs labeled A, B, and C of the second bracket 202 so that when coupled the labeled pairs provide the installer with multiple positions to accommodate various face frame constructions. As shown, the openings within a pair are found on the opposite sides of a centerline of the horizontal portion 206, and all of the openings can be symmetric about the center line. In addition, the centerline of the openings within a pair, such as pair A, is aligned, while the centerline of the openings between other pairs is laterally offset by a distance for permitting a predetermined adjustability of the second bracket 202 relative to the first bracket 180. For example, the offset distance between pair A and pair B and the offset distance between pair B and pair C may be identical or may vary; e.g., the offset distance of each may be about 0.125" for corresponding to 1½", 1⅝", and 1¾" face frame construction. It is to be understood by persons of ordinary skill in the art that the spacing and orientation of the openings 210 and pairs can vary depending on the desired location of the second bracket 202, and that providing offset distances between openings of pairs may also be associated with the openings of the first bracket 180. The longitudinal spacing between the centerlines within a pair of the second bracket 202 can also correspond to spacing between the centerlines within a pair of the first bracket 180; e.g., the longitudinal spacing between the centerlines of the openings of pair A of the first and second brackets 180, 202 are identical. The longitudinal spacing between the centerlines between openings of different pairs of the second bracket 202 can also correspond to spacing between the centerlines of different pairs of the first bracket 180, and may be identical or may vary; e.g., the longitudinal offset distance 213 between the centerlines of openings between pair A and pair B may be identical; e.g., the offset can be about 0.35".

The second bracket horizontal portion 202 may also include a slot 212 along one or more of the rear and front edges thereof. The longitudinal spacing between the slots 212 of the second bracket 202 can also correspond to spacing between the slots 200 of the first bracket 180. As shown, a portion may be removed from the middle of the body of the second bracket horizontal portion to allow finger portions 214 along the rear and front edges thereof to extend past the lateral edge 211 of the middle of the body. The finger portions 214 are configured to extend laterally past the lateral surface 188 of the first bracket when associated therewith for permitting greater lateral adjustability. The slots 212 are preferably positioned within and along the finger portions 214, and the slots 212 may also extend past the lateral edge 211. Another pair of openings 216, labeled D, may also be included and positioned and sized in relationship to the slots 212; e.g., the centerline of openings D may be alignment with centerline of slot 212. Strengthening ribs may also be included at the transition between the vertical and horizontal portions.

Figure 8B:
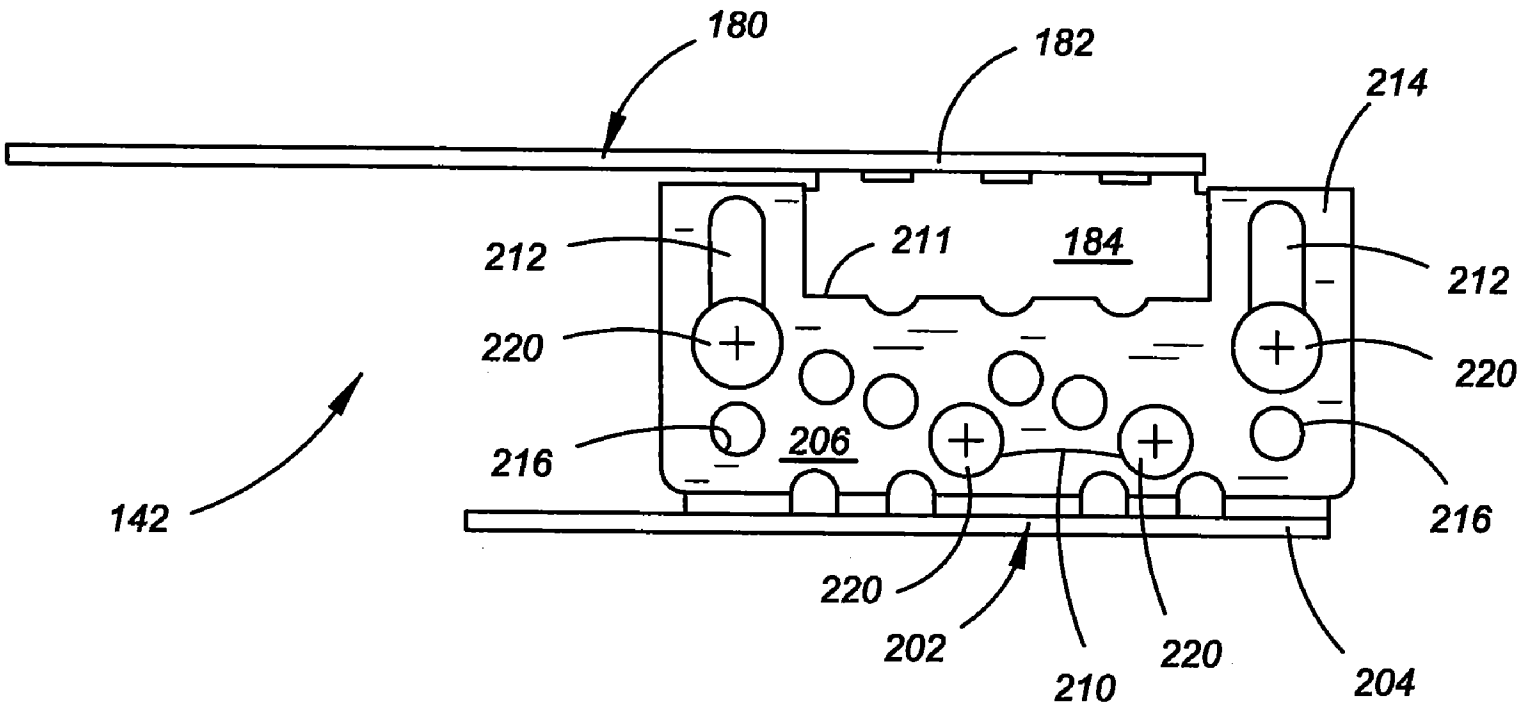
FIG. 8*b* is a top view of another embodiment of an adjustable bracket.

As shown in FIG. 8*b*, the first and second brackets 180, 202 of the adjustable bracket 142 can be coupled to one another through the use of one or more fasteners 220 through the pertinent openings. For example, after the first bracket horizontal portion 184 is positioned underneath the second bracket horizontal portion 206, the pair of openings 198, 210 labeled A for each of the first and second brackets 180, 202 are aligned and a fastener 220 is extended through each of the openings of the pair. Also, the slots 200, 212 of each of the first and second brackets are also aligned and a fastener 220 is extended through each of the slots. The fasteners 220 can be any known in the art, but preferably are bolt and nut combinations that are removably attached as known in the art. When mounted to the cabinet, the vertical portion 182 of the first bracket can be laterally spaced a lateral distance 221 from the vertical portion 204 of the second bracket such that a portion of the drawer side panel 128 and the respective drawer slide rail 115 fits within the distance 221, as shown in FIG. 7*a*. This arrangement permits the drawer slide rail to be concealed within the drawer side panel and allows for the top mounting of the drawer within the cabinet.

Figure 9D:
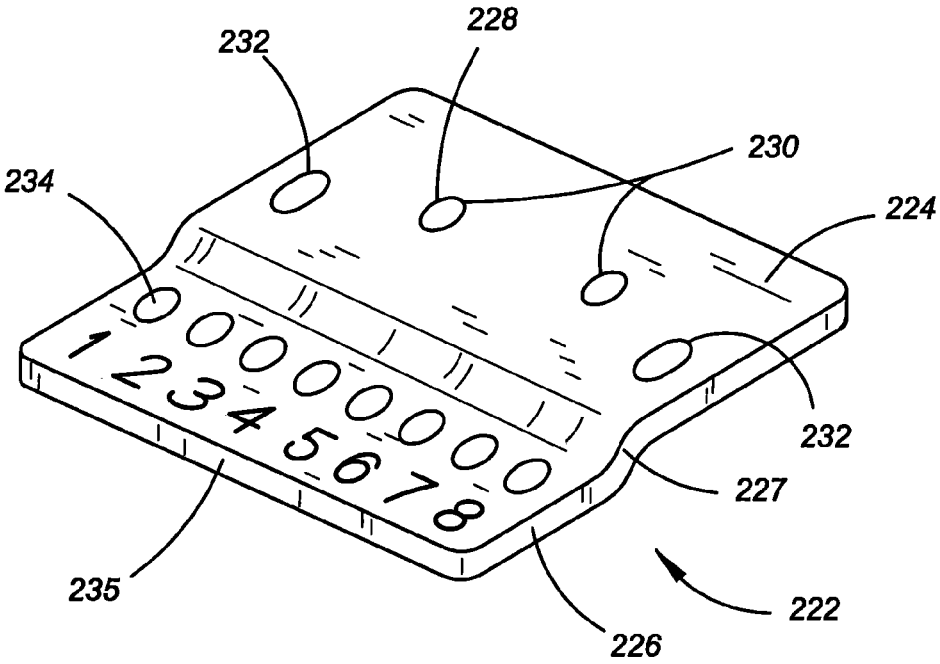
FIG. 9*d* is a perspective view of a mending plate of an adjustable bracket.

Referring back to FIG. 8*a*, the adjustable bracket 142 may also include a mending plate 222 that couples to the first and second brackets 180, 202. The mending plate 222 is particularly useful when the laterally spaced distance 221 between vertical portions of the first and second bracket 180, 202 is at its greatest; e.g., frameless cabinet construction. As shown in FIG. 9*d*, the mending plate 222 can have a generally rectangular body including a first portion 224 and a second, elevated portion 226. A sharp flange may be used to transition between the first and second portions 224, 226, but preferably a smoother transition 227 is provided where the transition is angled about 45° relative to the face of the first portion. The elevation difference between the first and second portions 224, 226 should be at least the thickness of the first bracket horizontal portion 184. The first portion 224 can have one or more openings 228 that can be further subdivided into a first pair 230 of openings for connecting to the second bracket 202 and a second pair 232 of slots for connecting to the first and second brackets 180, 202. In other words, the first pair 230 can be located to be in alignment with the pair of openings 198 labeled B in the first bracket 180, while the second pair 232 can be located to be in alignment with the slots 200 of the first bracket 180 and the slots 212 of the second bracket 202.

The second portion 226 can also have one or more openings 234 for connecting to the second bracket 202, preferably a series of openings, labeled as 1, 2, 3, 4, 5, 6, 7, and 8, and aligned with the lateral edge 235 of the second portion. In other embodiments, at least the openings labeled 1 and 8 may be offset from the rest of the openings by a distance to a position the openings closer to the lateral edge. The openings 234 of the second portion 226 are located to be in alignment with any pair of openings 210 or 216 labeled A, B, C, and D or slots 212 of the second bracket 202. For example, the longitudinal spacing of the centerlines between openings 1 and 8 correspond to openings within pair D and slots 212 of the second bracket 202; between openings 2 and 5 correspond to openings within pair A of the second bracket; between openings 3 and 6 correspond to openings within pair B of the second bracket; and between openings 4 and 7 correspond to openings within pair C of the second bracket.

As shown In FIG. 8*a*, for example, the mending plate 222 can be coupled to the bottom of both of the first and second brackets 180, 202 through the use of one or more fasteners 220 inserted through the pertinent openings. For example, the first bracket horizontal portion 184 is positioned underneath the second bracket horizontal portion 206 so that the slots 200 of the first bracket 180 are aligned with the slots 212 of the second bracket 202. The mending plate 222 can then be positioned underneath both brackets 180, 202 such that the mending plate first portion 224 interfaces with the bottom surface of the first bracket horizontal portion 184 and the mending plate second portion 226 interfaces with the bottom surface of the second bracket horizontal portion 206. The first pair 230 of openings of the mending plate 222 is aligned with the pair of openings 198 labeled B in the first bracket 180. The second pair 232 of openings of the mending plate 222 is aligned with the slots 200, 212 of the first and second brackets 180, 202, respectively. The openings 234 of the mending plate second portion 226 can be aligned with the pair of openings 210 labeled C of the second bracket 202. Fasteners 220 are then extended through the respective aligned openings.

From the forgoing description of the structure and operation of a preferred embodiment of the present invention, it will be apparent to those skilled in the art that the present invention is susceptible to numerous modifications and embodiments within the ability of those skilled in the art and without exercise of the inventive facility. Accordingly, the scope of the present invention is defined as set forth of the following claims.

What is claimed is:

1. A cabinet slide assembly comprising:

a cabinet, a drawer, and at least one drawer slide mechanism coupling the drawer to the cabinet to permit movement of the drawer between a fully open position and a fully closed position, the cabinet comprising a floor, a pair of side walls, and a rear panel attached to the floor, the drawer comprising a rear panel and a pair of side panels attached to the rear panel, the at least one drawer slide mechanism comprising a front portion, a rear portion, and an intermediate portion positioned between the front portion and the rear portion;

a post attached to the cabinet and the at least one drawer slide mechanism, the post attached to the intermediate portion of the at least one drawer slide mechanism such that the at least one drawer slide mechanism is elevated above the cabinet floor and positioned between the post and the cabinet side wall; and a gas spring having a first end coupled to the post and a second end coupled to the drawer, the gas spring capable of swinging through an arc about the first end along a vertical plane, while the second end is movable with the movement of the drawer.

2. The cabinet slide assembly of claim 1, wherein the at least one drawer slide mechanism comprise a left drawer slide rail and a right drawer slide rail, each of the drawer slide rails being coupled along an interior surface of the drawer side panels such that a portion of the drawer slide rails is concealed.

3. The cabinet slide assembly of claim 2, wherein the rear portion of each of the drawer slide rails is attached to the cabinet rear panel, and the front portion of each of the drawer slide rails is attached to the cabinet.

4. The cabinet slide assembly of claim 2, wherein the post is an upright post attached to one of the drawer slide rails and the cabinet floor, the upright post positioned a lateral distance away from the cabinet side wall.

5. The cabinet slide assembly of claim 1, wherein the drawer rear panel has a slot formed in a wall thereof, and a mounting bracket is attached to one of the drawer side panels, having a mounting stud configured to couple to the second end of the gas spring, wherein the slot is dimensioned to receive the second end of the gas spring for coupling to the mounting stud.

6. The cabinet slide assembly of claim 1, further comprising an adjustable bracket coupling a portion of the cabinet to the front portion of the at least one drawer slide mechanism, the adjustable bracket configured to provide the at least one drawer slide mechanism lateral adjustability relative to the cabinet side wall.

7. The cabinet slide assembly of claim 1, wherein the post comprises a foot member attached to the cabinet and an adjustable member slidably attached to the foot member, the adjustable member attached to the intermediate portion of the at least one drawer slide mechanism, wherein the adjustable member is positionable relative to the foot member based on a height of the at least one drawer slide mechanism above the cabinet floor.

8. The cabinet slide assembly of claim 1, wherein the gas spring comprises a compressed position upon movement of the drawer through an intermediate position located between the fully open position and the fully closed position.

9. The cabinet slide assembly of claim 8, wherein the gas spring comprises an extended position when the drawer is at at least one of the fully open position and the fully closed position.

10. The cabinet slide assembly of claim 8, wherein the gas spring is oriented substantially perpendicular to the slide mechanism when the drawer is at the intermediate position.

11. The cabinet slide assembly of claim 8, wherein the gas spring is situated to facilitate a reduction of speed of the drawer as the drawer approaches at least one of the fully closed position and the fully open position.

12. The cabinet slide assembly of claim 8, wherein the gas spring is self-extendable from the compressed position to an extension position such that the drawer is movable from the intermediate position without an external force.

13. A cabinet slide assembly comprising:

a cabinet, a drawer, a left drawer slide rail and a right drawer slide rail coupling the drawer to the cabinet to permit movement of the drawer between a fully open position and a fully closed position, the cabinet comprising a floor, a pair of side walls, and a rear panel attached to the floor, the drawer comprising a rear panel and a pair of side panels attached to the rear panel, each of the drawer slide rails comprising a front portion, a rear portion coupled to the cabinet rear panel, and an intermediate portion positioned between the front portion and the rear portion;

an upright post mounted between one of the drawer slide rails and the cabinet floor, the post attached to the intermediate portion of the one of the drawer slide rails such that the drawer slide rails are elevated above the cabinet floor and positioned between the post and the cabinet side wall;

a gas spring having a first end coupled to the upright post and a second end coupled to the drawer, the gas spring capable of swinging through an arc about the first end along a vertical plane, while the second end is movable with the movement of the drawer; and an adjustable bracket coupling a portion of the cabinet to the front portion of the one of the drawer slide rails, the adjustable bracket configured to provide the drawer slide rail lateral adjustability relative to the cabinet side wall.

14. The cabinet slide assembly of claim 13, wherein the adjustable bracket comprises:

a first bracket having a vertical portion and a lower, horizontal portion extending laterally toward the center of the cabinet, the vertical portion having one or more holes for receiving a fastener for attachment to the cabinet; and a second bracket having a vertical portion and a lower, horizontal portion extending laterally toward the cabinet side wall, the vertical portion having one or more holes for receiving a fastener for attachment to the drawer slide rail, and wherein the horizontal portion of each of the first and second brackets comprises one or more holes, and the horizontal portion of the first bracket interfaces the horizontal portion of the second bracket such that holes thereof are aligned for receiving a fastener for attachment of the first bracket to the second bracket.

15. The cabinet slide assembly of claim 14, wherein the cabinet includes a face frame attached to a front of the cabinet, opposite the rear panel thereof, and the vertical portion of the first bracket attaches to said face frame.

16. The cabinet slide assembly of claim 14, wherein the vertical portion of the first bracket attaches to an interior surface of the cabinet side wall.

17. The cabinet slide assembly of claim 14, wherein the vertical portion of the first bracket is laterally spaced a distance from the vertical portion of the second bracket such that a portion of the drawer side panel and the respective drawer slide rail fits within said distance.

18. The cabinet slide assembly of claim 14, wherein the adjustable bracket further comprises a mending plate interfacing a lower surface of the horizontal portion of each of the first and second brackets.

19. The cabinet slide assembly of claim 18, wherein the mending plate comprises one or more first holes and one or more second holes, the mending plate interfacing the lower surface of the horizontal portion of each of the first and second brackets such that said first hole of the mending plate is aligned with one or more of the holes of the first bracket horizontal portion for receiving a fastener for attachment therebetween, and said second hole of the mending plate is aligned with one or more of the holes of the second bracket horizontal portion for receiving a fastener for attachment therebetween.

* * * * *